US005749103A

United States Patent [19]

Kreemer

[11] Patent Number: 5,749,103

[45] Date of Patent: May 12, 1998

[54] TOILET SEAT HAVING A SANITARY LIFTING SURFACE

[75] Inventor: Gary Allen Kreemer, Pickerington, Ohio

[73] Assignee: The Sanilift Company, Ltd., Pickerington, Ohio

[21] Appl. No.: 617,137

[22] Filed: Mar. 18, 1996

Related U.S. Application Data

[63] Continuation-in-part of Ser. No. 372,224, Jan. 13, 1995, Pat. No. 5,511,252.

[51] Int. Cl.[6] ..... A47K 13/00

[52] U.S. Cl. ..... 4/237; 4/246.1

[58] Field of Search ..... 4/235, 237, 239, 4/246.1; 16/124

[56] References Cited

U.S. PATENT DOCUMENTS

| | | | |
|---|---|---|---|
| D. 273,128 | 3/1984 | Roddick | D23/71 |
| D. 288,471 | 2/1987 | Gladstone | D23/71 |
| D. 296,658 | 7/1988 | Mead et al. | D8/305 |
| D. 309,091 | 7/1990 | Shepard | D8/305 |
| D. 325,510 | 4/1992 | Slye | D8/307 |
| D. 326,599 | 6/1992 | Callahan | D8/307 |
| D. 329,187 | 9/1992 | Sorensen | D8/307 |
| 962,501 | 6/1910 | Edwards | 16/124 X |
| 1,999,555 | 1/1935 | Adams | 4/251 |
| 2,236,576 | 4/1941 | Loebner | 4/246.1 |
| 2,251,770 | 8/1941 | Warner | 4/251 |
| 2,473,082 | 6/1949 | Warner | 4/251 |
| 2,758,315 | 8/1956 | Hylton | 4/251 |
| 3,191,193 | 6/1965 | Bogenberger | 4/251 |
| 3,594,831 | 7/1971 | Brewer | 4/237 |
| 3,717,884 | 2/1973 | Mantooth | 4/237 |
| 3,783,455 | 1/1974 | Vanderbrook | 4/1 |
| 3,935,601 | 2/1976 | Hermann | 4/246.1 |
| 4,129,907 | 12/1978 | Vaughan et al. | 4/246.1 |
| 4,574,401 | 3/1986 | Nakajima | 4/246.1 |
| 4,742,582 | 5/1988 | Giallourakis | 4/251 |
| 4,805,246 | 2/1989 | De Vargas et al. | 4/251 |
| 4,850,062 | 7/1989 | Gibson et al. | 4/251 |
| 4,875,251 | 10/1989 | Hazard | 16/111 R |
| 5,037,272 | 8/1991 | Goodman | 16/114 |
| 5,065,460 | 11/1991 | Currin | 4/246.1 |
| 5,375,267 | 12/1994 | Davis | 4/246.1 |
| 5,511,252 | 4/1996 | Kreemer | 4/246.1 |

FOREIGN PATENT DOCUMENTS

| | | | |
|---|---|---|---|
| 0124222 | 1/1947 | Australia | 4/235 |

*Primary Examiner*—Charles E. Phillips
*Attorney, Agent, or Firm*—Ronald W. Kock

[57] ABSTRACT

A substantially annular toilet seat having a lifting surface which remains sanitary throughout a range of toilet seat positions between a toilet bowl and a toilet tank. The seat has a hinged end and an outer perimeter wall. The outer perimeter wall has a cavity therein which has a smooth inner surface and an open end facing outwardly from the toilet bowl. The seat has a hinging means connecting the hinged end the seat to the toilet bowl such that a user placing a finger in the cavity and pressing against the smooth inner surface may pivot the annular seat about the hinging means. This may be done without contamination of the finger because the cavity is shielded from urine splash and bacteria laden toilet water spraying outward from the toilet bowl when the toilet bowl is flushed. Alternatively, the toilet seat has a protrusion extending outwardly from the outer perimeter wall and having the cavity therein. The smooth inner surface of the cavity gradually converges from the open end to a closed end. The open end is substantially oval in shape and a cross-section of the cavity perpendicular to the open end is substantially parabolic in shape.

4 Claims, 2 Drawing Sheets

TOILET SEAT HAVING A SANITARY LIFTING SURFACE

CROSS-REFERENCE TO RELATED APPLICATION

This is a continuation-in-part of my prior application, Ser. No. 08/372,224, entitled "A Toilet Seat Lifting Handle Having A Sanitary Cavity", filed on Jan. 13, 1995, now U.S. Pat. No. 5,511,252.

FIELD OF THE INVENTION

The present invention relates to structures for lifting toilet seats, and more particularly to structures which are built into toilet seats.

BACKGROUND OF THE INVENTION

Devices for manually lifting toilet seats are old in the art. Their intent is to enable a person to lift or lower a toilet seat without having to touch the seat itself. It is desirable to avoid touching a toilet seat, which may have been contaminated by splash and/or aerosolized bacteria from the toilet bowl during previous uses. The underside of a toilet seat is the side which is normally contacted by one's fingers when lifting the seat. The underside is not readily visible when the seat is in its down or horizontal position. It is the underside of the toilet seat which may be particularly susceptible to contamination.

Males are mostly responsible for lifting toilet seats for the purpose of urinating while standing. When a seat is lifted to the vertical or upright position, the seat surface upon which one sits is somewhat protected from splash generated by urination into the bowl. However, the underside of the toilet seat is exposed to such splash. Furthermore, when a toilet is flushed the seat and lid are often in their horizontal positions. The seat is separated from the toilet bowl by rubber or plastic bumper pads. These relatively thick pads are intended to absorb impact when the hinged seat is accidentally dropped onto the ceramic bowl rim. When the seat is in its horizontal position and flushing occurs, it is well known that bacteria laden aerosol from the toilet bowl is expelled outwardly from between the seat and bowl, coating the underside of the seat with contamination. In order to lift a toilet seat without contaminating one's fingers, it is necessary to provide a seat lifting surface which is shielded from splashes and bacteria laden aerosol from the toilet bowl.

OBJECTS OF THE INVENTION

In light of the above, an object of the present invention is to provide a toilet seat having a sanitary cavity for finger contact, the opening of which faces away from the toilet bowl regardless of the position of the toilet seat.

Another object of the present invention is to provide a toilet seat molded of plastic which has an attractive outer shape having smooth, rounded edges to avoid snagging clothing, causing leg abrasion, or causing difficulty with sanitization.

SUMMARY OF THE INVENTION

In one preferred aspect of the present invention, a toilet seat, having a lifting surface which remains sanitary throughout a range of toilet seat positions between a toilet bowl and a toilet tank, comprises a substantially annular seat and a hinging means. The annular seat has a hinged end and an outer perimeter wall. The outer perimeter wall has a cavity therein, the cavity having a smooth inner surface and an open end facing outwardly from the toilet bowl. The hinging means connects the hinged end of the annular seat to the toilet bowl such that a user placing a finger in the cavity and pressing against the smooth inner surface may pivot the annular seat about the hinging means within the range of toilet seat positions. Such pressing is accomplished without contamination of the finger from urine splash and bacteria laden toilet water spraying outward from the toilet bowl when the toilet is flushed. The toilet seat may further comprise a protrusion extending outwardly from the outer perimeter wall, such that the protrusion has the cavity therein. The cavity is preferably located at least 20° around the outer perimeter wall from the hinging means. The smooth inner surface of the cavity may gradually converge from the open end to a closed end. The open end may be substantially oval in shape and a cross-section of the cavity perpendicular to the open end may be substantially parabolic in shape.

In another aspect of the present invention, a toilet seat has a lifting surface which remains sanitary throughout a range of toilet seat positions between a toilet bowl and a toilet tank, and the toilet seat comprises a substantially annular seat and a hinging means. The substantially annular seat has a hinged end and an outer perimeter wall. The outer perimeter wall has a cavity therein. The cavity has a substantially radial axis located at an angle of at least 20° around the outer perimeter wall from the hinging means. The cavity has a smooth inner surface and an open end sufficiently large enough for at least one of a user's fingers to enter the cavity. The open end faces outwardly from the toilet bowl. The smooth inner surface gradually converges from the open end to a closed end.

The hinging means connects the hinged end of the annular seat to the toilet bowl such that a user placing a finger in the cavity and pressing against the smooth inner surface may pivot the annular seat about the hinging means within the range of toilet seat positions. The cavity is shielded from urine splash and bacteria laden toilet water spraying outward from the toilet bowl when the toilet bowl is flushed, so that the finger of the user is not contaminated by lifting the toilet seat.

In yet another aspect of the present invention, a toilet seat has a lifting surface which remains sanitary throughout a range of toilet seat positions between a toilet bowl and a toilet tank. The toilet seat comprises a substantially annular seat and a hinging means. The annular seat has a hinged end and a protrusion extending outwardly from the annular seat. The protrusion has a cavity therein. The cavity has a smooth inner surface and an open end facing outwardly from the toilet bowl. The hinging means connects the hinged end of the annular seat to the toilet bowl such that a user placing a finger in the cavity and pressing against the smooth inner surface may pivot the annular seat about the hinging means within the range of toilet seat positions. The cavity is shielded from urine splash and bacteria laden toilet water spraying outward from the toilet bowl when the toilet bowl is flushed, so that the finger of the user is not contaminated by lifting the toilet seat. The protrusion may be located at least 20° around the outer perimeter wall from the hinging means. The smooth inner surface of the cavity may gradually converge from the open end to a closed end. The open end of the cavity may be substantially oval in shape and a cross-section of the cavity perpendicular to the open end may be substantially parabolic in shape.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements.

DETAILED DESCRIPTION OF THE INVENTION

Figure 1:
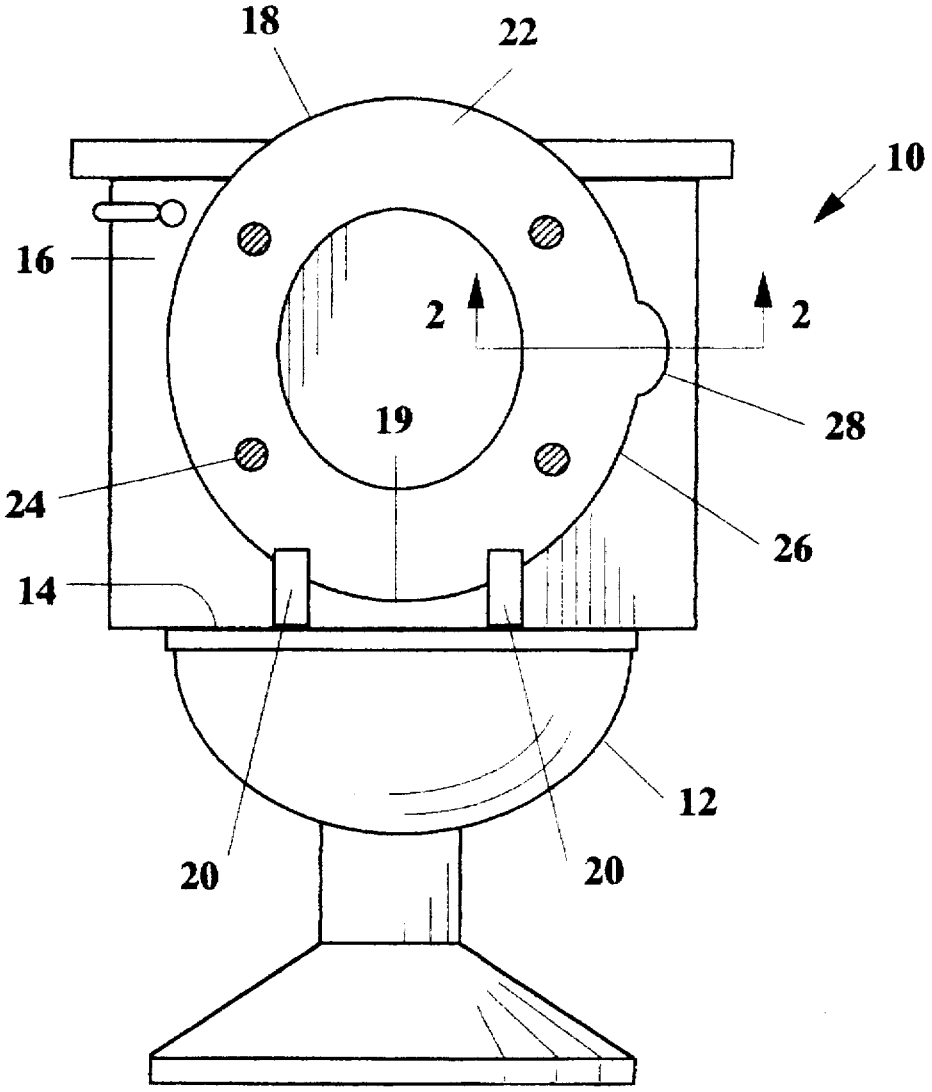
FIG. 1 is a front elevation view of a toilet seat having a sanitary lifting surface of the present invention, showing a protrusion extending from the outer wall of the toilet seat.
Figure 2:
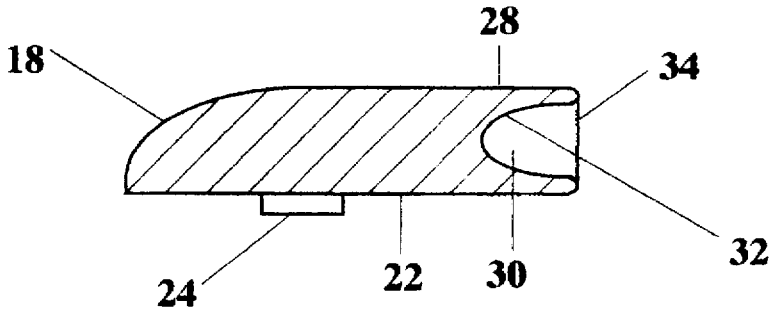
FIG. 2 is a sectioned view of the toilet seat of FIG. 1, taken along section lines 2—2 of FIG. 1, showing an outwardly facing cavity in the protrusion.

Referring now to the drawings, and more particularly to FIGS. 1 and 2, there is shown a preferred embodiment of the present invention, disclosing a toilet, generally indicated as 10. Toilet 10 has a bowl 12, a bowl rim 14, and a water tank 16. Toilet 10 also has an annular toilet seat 18, which is hinged at a hinged end 19 from bowl rim 14 by a pair of hinges 20. Seat 18 has two positions: horizontal for sitting thereon (not shown), and upright such that seat 18 rests against water tank 16. Seat 18 typically has a flat underside 22, which has a plurality of rubber or plastic bumper pads 24. Pads 24 space seat 18 away from bowl rim 14 when seat 18 is in its horizontal position.

Annular seat 18 has an outer perimeter wall 26 and a protrusion 28 extending outwardly from outer perimeter wall 26. Protrusion 28 has a cavity 30 therein. Cavity 30 has a smooth inner surface 32 which is easily cleanable. Cavity 30 has an outwardly facing open end 34, which is preferably oval in shape; and smooth inner surface 32 preferably is parabolic in shape such that it gradually converges from open end 34 toward a closed end. Open end 34 is large enough for inserting one or more fingers for the purpose of lifting the toilet seat. The benefit of having protrusion 28 is that the thickest part of toilet seat 18 may extend to where cavity 30 is located so that cavity 30 may have as large an opening as possible. It is important that open end 34 be large enough that a user can not only insert one or more fingers, but also that cavity 30 can easily be wiped clean periodically. Most importantly, open end 34 faces outwardly so that vertically falling splash and outwardly directed aerosolized bacteria from toilet flushing cannot readily enter cavity 30. Thus, smooth inner surface 32 is shielded from contamination and is maintained sanitary for lifting and lowering purposes.

Protrusion 28 may be located on either the right or left side of toilet seat 18. Alternatively, more than one protrusion 28 and cavity 30 may be in outer perimeter wall 26. In order to minimize the lifting force required to lift toilet seat 18, it is beneficial to locate protrusion 28 as far from hinged end 19 as possible. However, it is also desirable for protrusion 28 to not interfere with sitting on toilet seat 18. Therefore, the location of protrusion 28 is preferably at least 20° from either side of hinged end 19. Although protrusion 28 may be up to 180° from hinged end 19, most preferably protrusion 28 is about 90° from hinged end 19 so that open end 34 will face outward from toilet bowl 14 regardless of the position of seat 18.

Edges of cavity open end 34 are generously radiused to avoid snagging one's clothing or otherwise causing discomfort when sitting on or lifting toilet seat 18. Avoidance of sharp edges and providing surface smoothness is also intended for child safety purposes. Although the paraboloid shape of inner surface 22 is preferred, it could also be hemispherical, polygonal, or just about any other relatively smooth converging shape.

Protrusion 28 is preferably molded into toilet seat 18, and such construction enables rounded and smooth surfaces to be easily provided.

Figure 3:
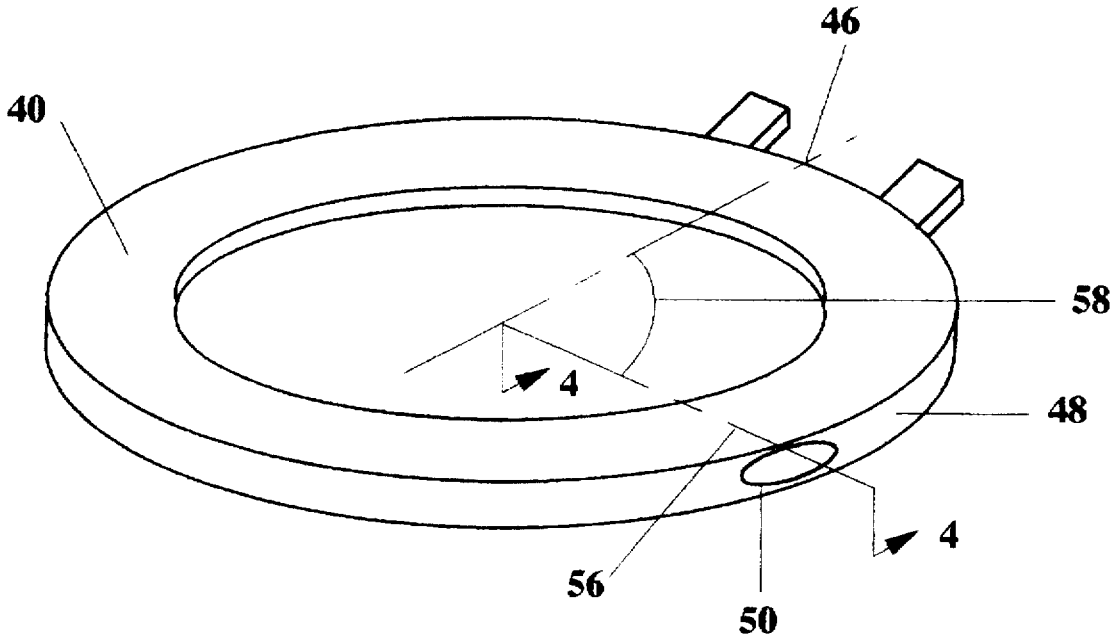
FIG. 3 is a perspective view of an alternative toilet seat having a sanitary lifting surface of the present invention, showing an outwardly facing cavity in the outer perimeter wall of the toilet seat without a protrusion.
Figure 4:
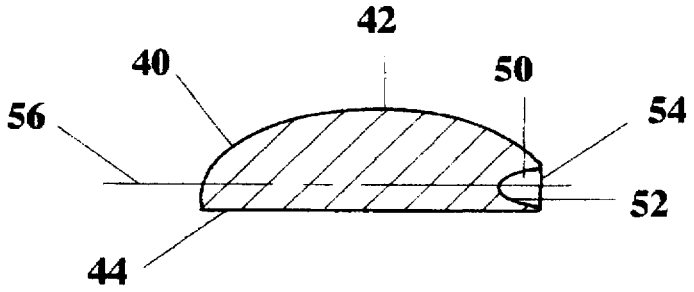
FIG. 4 is a sectioned view of the toilet seat of FIG. 3, taken along section line 4—4 of FIG. 3, showing the outwardly facing cavity.

FIGS. 3 and 4 show an alternative annular toilet seat 40. Toilet seat 40 has a top surface 42, a flat underside 44, a hinged end 46, and an outer perimeter wall 48. Outer perimeter wall 48 has a cavity 50. Cavity 50 has a smooth inner surface 52 and an outwardly facing open end 54, which is preferably oval in shape. Similar to smooth inner surface 22, smooth inner surface 52 preferably is parabolic in shape such that it gradually converges from open end 54 toward a closed end. Open end 54 is preferably large enough for inserting one or more fingers for the purpose of lifting the toilet seat. Although no protrusion is available, the cross-sections of most toilet seats permit cavities of sufficient size for at least one finger to be machined or molded in. Most importantly, open end 54 faces outwardly so that vertically falling splash and outwardly directed aerosolized bacteria from toilet flushing cannot readily enter cavity 50. Thus, smooth inner surface 52 is shielded from contamination and is maintained sanitary for lifting and lowering purposes.

Cavity 50 may be located on either the right or left side of toilet seat 40. Alternatively, more than one cavity 50 may be in outer perimeter wall 48. In order to minimize the lifting force required to lift toilet seat 40, it is beneficial to locate cavity 50 as far from hinged end 46 as possible. However, it is also desirable for cavity 50 to not interfere with sitting on toilet seat 40. Therefore, the location of cavity 50 is preferably at least 20° from either side of hinged end 46. Although cavity 50 may be up to 180° from hinged end 46, most preferably cavity 50 has an axis 56 substantially radial to annular toilet seat 40 and an angle 58 substantially 90° from hinged end 46 so that open end 54 will face outward from the toilet bowl regardless of the position of seat 40 between horizontal and upright.

Edges of cavity open end 54 are generously radiused to avoid snagging one's clothing or otherwise causing discomfort when sitting on or lifting toilet seat 40. Avoidance of sharp edges and providing surface smoothness is also intended for child safety purposes. Although the paraboloid shape of inner surface 52 is preferred, it could also be hemispherical, polygonal, or just about any other relatively smooth converging shape.

In a particularly preferred embodiment of the present invention, cavity 50 has a depth of 25 mm, and open end 54 has a length of 57 mm and a width of 32 mm.

It is thought that the toilet seat having a sanitary lifting surface of the present invention, and many of its attendant advantages, will be understood from the foregoing description; and it will be apparent that various changes may be made in form, construction, and arrangement without departing from the spirit and scope of the invention or sacrificing all of its material advantages, the forms hereinbefore described being merely preferred or exemplary embodiments thereof.

What is claimed is:

1. A toilet seat having a lifting surface which remains sanitary throughout a range of toilet seat positions between a toilet bowl and a toilet tank, said toilet seat having upper and lower surfaces bounded in an outward direction by an outer perimeter wall;

a) said toilet seat having a hinged end, said outer perimeter wall having a cavity therein defining said lifting surface, said cavity having a smooth inner surface gradually converging to a closed end, and an open end facing outwardly from said toilet bowl, said cavity having generously rounded outer edges leading from said inner surface to said outer perimeter wall, said inner surface being shielded from splashes when one urinates into said toilet bowl with said toilet seat located anywhere within a range of positions, said inner surface also being shielded from bacteria laden aerosolized toilet water spraying outward from said toilet bowl when said toilet bowl is flushed;

b) a hinging means connecting said hinged end of said seat to said toilet bowl such that a user placing a finger in said cavity and pressing against said smooth inner surface may pivot said toilet seat about said hinging means within said range of toilet seat positions without contamination of said finger from urine splash and bacteria laden toilet water spraying outward from said toilet bowl.

2. The toilet seat of claim 1 wherein said open end is substantially oval in shape and a cross-section of said cavity perpendicular to said open end is substantially parabolic in shape, said cavity being shaped to be easily wiped clean.

3. The toilet seat of claim 1 wherein said cavity has depth of about 25 mm.

4. A toilet seat having a lifting surface which remains sanitary throughout a range of toilet seat positions between a toilet bowl and a toilet tank, said toilet seat comprising:

a) a toilet seat having a top surface and a flat underside, a hinged end and a protrusion extending outwardly from said seat, said protrusion having a cavity therein located entirely between said top surface and said flat underside, said cavity having a smooth inner surface gradually converging to a closed end and an open end facing outwardly from said toilet bowl, said cavity having generously rounded outer edges, said open end being substantially oval in shape and wherein a cross-section of said cavity perpendicular to said open end is substantially parabolic in shape, said cavity being shaped to be easily wiped clean; and b) a hinging means connecting said hinged end of said annular seat to said toilet bowl such that a user placing a finger in said cavity and pressing against said smooth inner surface may pivot said annular seat about said hinging means within said range of toilet seat positions, said cavity being shielded from urine splash and bacteria laden toilet water spraying outward from said toilet bowl when said toilet bowl is flushed, so that said finger of said user is not contaminated by lifting said toilet seat.

* * * * *